US006325257B1

(12) United States Patent
Micciche' et al.

(10) Patent No.: US 6,325,257 B1
(45) Date of Patent: Dec. 4, 2001

(54) CLOTH HANGER AND METHOD THEREOF

(76) Inventors: Carlo Micciche', Via Franchi Maggi, 26, 20089 Quinto dé Stampi (Rozzano), Milano; Luca Micciche', Piazza Mondadori 4, 20100 Milano, both of (IT)

( * ) Notice: Subject to any disclaimer, the term of this patent is extended or adjusted under 35 U.S.C. 154(b) by 0 days.

(21) Appl. No.: 09/679,976

(22) Filed: Oct. 5, 2000

(30) Foreign Application Priority Data

Oct. 8, 1999 (IT) ..... MI99A2111

(51) Int. Cl.[7] ..... A47G 25/14

(52) U.S. Cl. ..... 223/87; 223/85

(58) Field of Search ..... 223/85, 92, 87, 223/88, 89, 94

(56) References Cited

U.S. PATENT DOCUMENTS

| | | | | |
|---|---|---|---|---|
| 2,299,977 | * | 10/1942 | Guyer | 223/87 |
| 2,306,254 | * | 12/1942 | Quackenbush | 223/87 |
| 2,378,922 | * | 6/1945 | Grant | 223/85 |
| 2,383,819 | * | 8/1945 | Ronning | 223/87 |
| 2,393,074 | * | 1/1946 | Thompson et al. | 223/87 |

* cited by examiner

*Primary Examiner*—Bibhu Mohanty
(74) *Attorney, Agent, or Firm*—Hedman & Costigan, P.C.

(57) ABSTRACT

An improved triangular construction cloth hanger comprises a strip of a paperboard or plastic material, or of a laminate material, including two top wings symmetrically slanted to one another, and coupled to one another by a middle top portion and a bottom strip portion having a plurality of ridges made by forming through the strip body a plurality of longitudinal or slanted ribs and die cut portions and cut-outs, for providing the sheet material strip with a crowned construction.

6 Claims, 4 Drawing Sheets

CLOTH HANGER AND METHOD THEREOF

BACKGROUND OF THE INVENTION

The present invention relates to a method for making an improved cloth hanger.

The invention further relates to the improved cloth hanger made by the above method.

In the field of the cloth manufacturing, dry cleaning and laundry shops, it is very important to put, for exhibiting and preserving purposes, the cloth articles on cloth hangers.

These cloth hangers, on the other hand, must have a very small cost and a high operating reliability.

SUMMARY OF THE INVENTION

Accordingly, the main object of the present invention is to provide a cloth hanger having very good aesthetic characteristics, a small weight and which can be easily disposed of.

Actually, the above mentioned cloth hangers are conventionally made in a large series as "disposable" articles, produced on a large mass basis in several hundred thousands through the world.

Thus, it would be very important to dispose of, as stated, the used cloth hangers in a not polluting manner.

The latter requirements, on the other hand, cannot be met satisfactorily by conventional cloth hangers including different materials such as plastic or wire materials, which solve only partially the above mentioned disposal problem.

The above mentioned object is achieved by a cloth hanger as claimed in claim 1.

A further object of the invention is to provide a method for making a cloth hanger having a triangular construction of a paperboard material, i.e. a small weight and high strength construction, which can be simply made and/or recycled, in order to provide a disposable cloth hanger specifically designed for supporting cloth articles during end processing operations thereof, and for easily storing and/or transporting said cloth articles.

The invention fully provides to achieve the following advantageous results:

- an optimizing of the strength/thickness ratio, in using a paper board material, and this owing to the disclosed making method in which one or more strips are used for making said cloth hangers, said strips including a longitudinal ribbed pattern, either of a simple or double nature, the ribs of said rib pattern being partially bent from the central axial portion of the strip toward the peripheral portion of the strip to provide a tridimensional crowned profile allowing to easily made a plurality of ribs for properly reinforcing the cloth hanger structure, while using a material having a comparatively small mechanical strength;
- a great reduction of the cloth hanger weight and space size, thereby providing a very small storing and shipment size therefor;
- an optimizing of the cloth hanger assembling speed;
- an optimizing of the cloth hanger making cost, with the possibility of easily recycling and disposing of the used cloth hangers, without environmental polluting problems, since the used material is an efficiently biodegradable material.

BRIEF DESCRIPTION OF THE DRAWINGS

The above and other objects of the present invention would become more apparent hereinafter from the figures of the accompanying drawings, which show, by way of an illustrative but not limitative example, several embodiments of the cloth hanger according to the invention, and in which.

DESCRIPTION OF THE PREFERRED EMBODIMENTS

With reference to the number references of the above mentioned figures, the method for making the cloth hanger according to the present invention, generally indicated by the reference number 1, provides to use a cardboard strip, having any set length, which is so ribbed as to be easily partially bent, in order to provide the strip with a tridimensional configuration or pattern, with a crowned arrangement, for providing the triangular structure 2.

The above mentioned ribbed patterns and partial bent portions, as well as the closing and fixing means of the subject cloth hanger will provide said cardboard or paperboard strip with a suitable mechanical strength adapted to resist against the use conditions of the cloth hanger.

Figure 1:
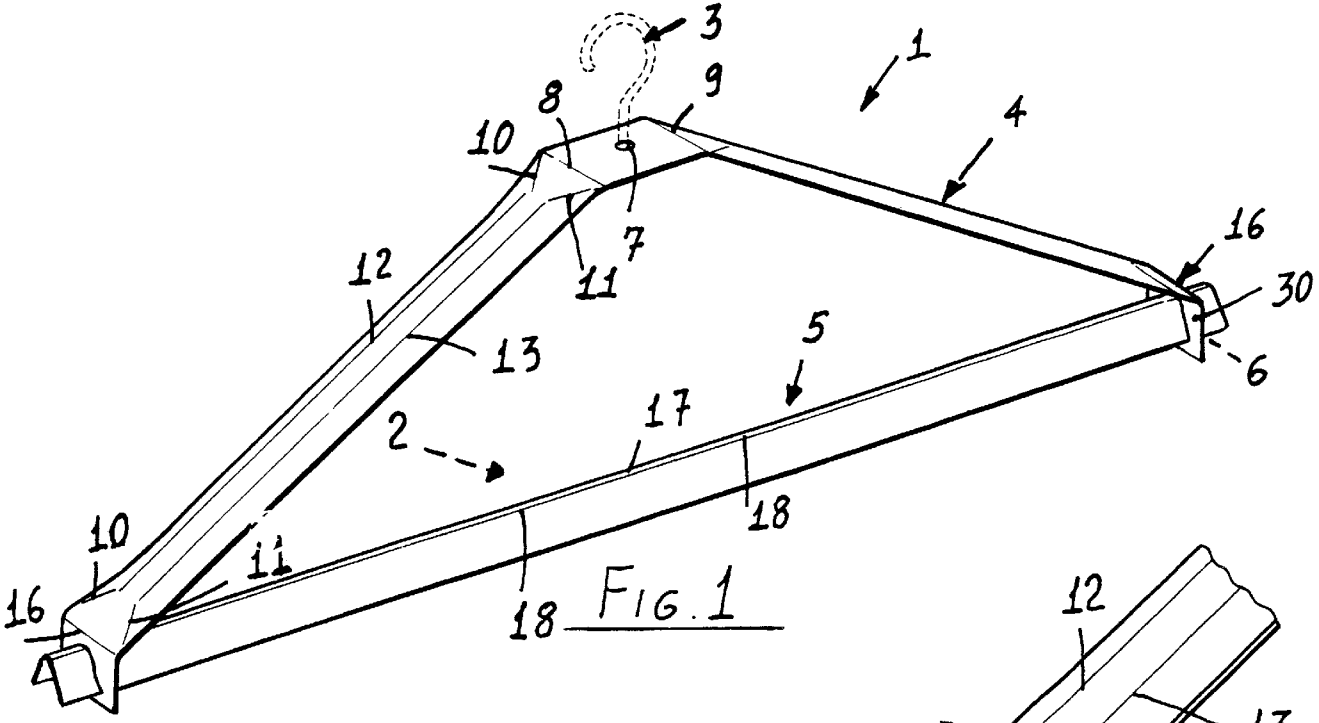
FIG. 1 is a side perspective view of an improved cloth hanger according to the invention, in a first embodiment thereof, the cloth hanger comprising substantially two elements, made from a sheet material, preferably a cardboard material, therefrom several strips are formed, each having a set length and being partially ribbed and bent, to provide a tridimensional crowned profile and an optional hook-shape lug, provided for engaging in a hole arranged at the central portion of a flat middle region formed at a top apex portion.

As clearly shown in FIG. 1, a first embodiment of the cloth hanger is made by using two strip portions 4 and 5 of different lengths.

Said strip portions are subjected to several processing steps.

More specifically, the single-piece strip 4 forms the two top sides of the composite construction 2 and is at the start partially ribbed at the portions shown by the lines 12 and 13, suitably spaced from one another, and at that portions corresponding to the other side, not shown in FIG. 1.

Figure 2:
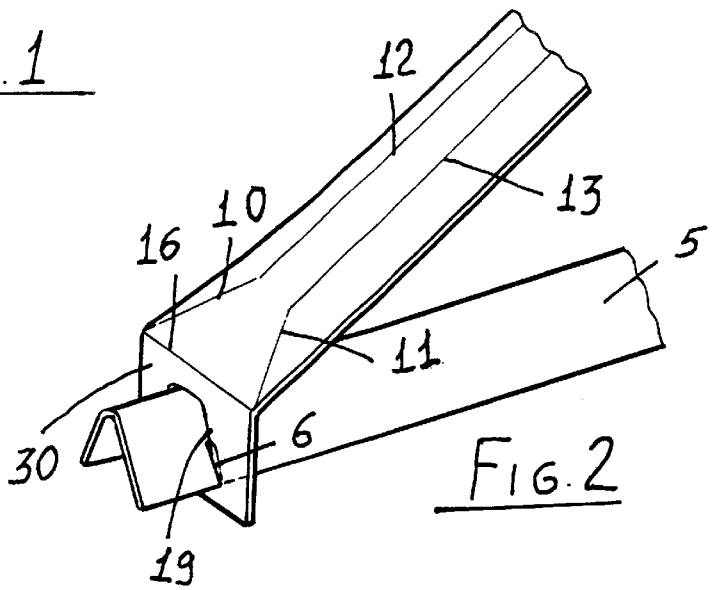
FIG. 2 is a further side and partial perspective view of the cloth hanger shown in FIG. 1.
Figure 3:
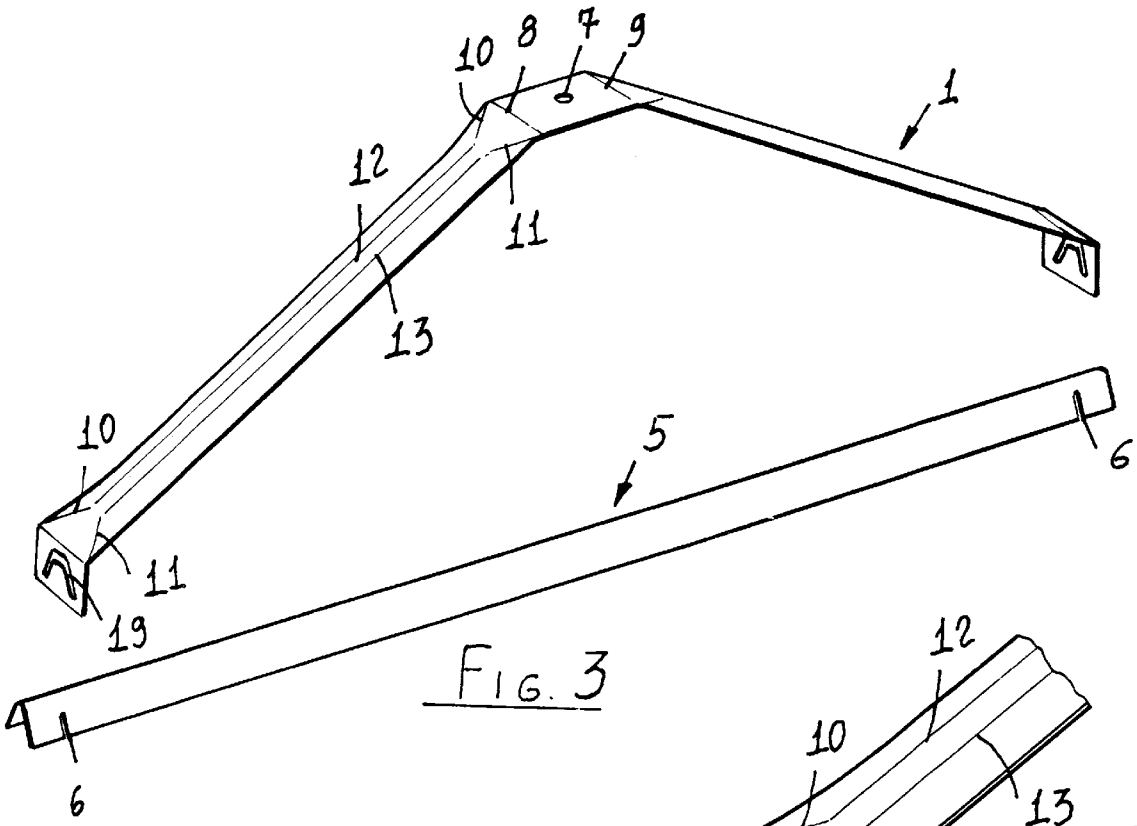
FIG. 3 is a further side perspective view of the improved cloth hanger shown in FIG. 1, in which the two main components of the cloth hanger are shown in a fully separated condition, in order to clearly show the making and assembling details of the cloth hanger strips and joint means.
Figure 4:
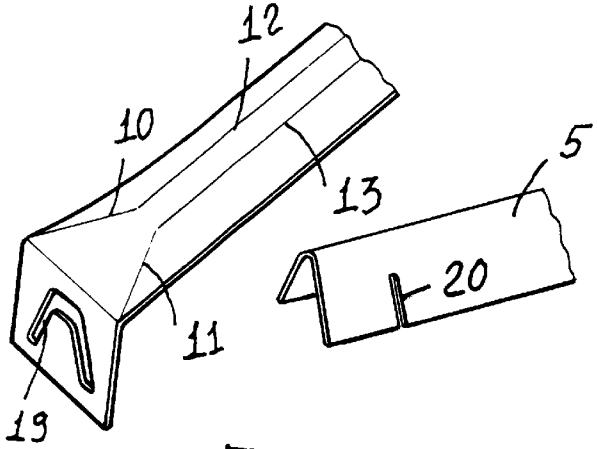
FIG. 4 is a partial side perspective view of one of the two bottom apex portions of the cloth hanger shown in FIG. 1, in which the two main components of the cloth hanger are shown in a fully separated condition, to clearly illustrate the making and assembling details both of the strips and of the cloth hanger junction regions.

Said strip is then cut by a shearing operation at the two end portions thereof, in order to provide the reversed "U" hollows 19 (see FIGS. 2 and 3), for receiving junction means 6 and being perforated by punching at the central portion thereof, to provide a hole 7 for engaging therein a hook element 3.

The strip 4 is bent along the lines 16, 8 and 9 symmetrically arranged with respect to the hole 7, and accordingly to the lines 10 and 11 slanted at 45° with respect to the line 8 and, on the other side, according to corresponding lines, with respect to the line 9.

Said strip is moreover bent along the bending lines 10 and 11 at 45° with respect to the line 16 as well as along the line corresponding to the other side, not shown in FIG. 1.

The strip 5, in turn, is at first ribbed along the lines 17 and 18 arranged at a suitable spacing from one another.

This spacing must fit the base width of the reversed U hollow 19.

Then, the strip 5 is die-cut to provide the groove cut-outs 20, and finally it is partially bent along the bending lines 17 and 18.

The mentioned partial ribs will provide stiffening ribs providing the cloth hanger construction with a high mechanical strength.

Moreover, the cut-outs and bent portion will allow to make the fixed junctions 6.

Figure 5:
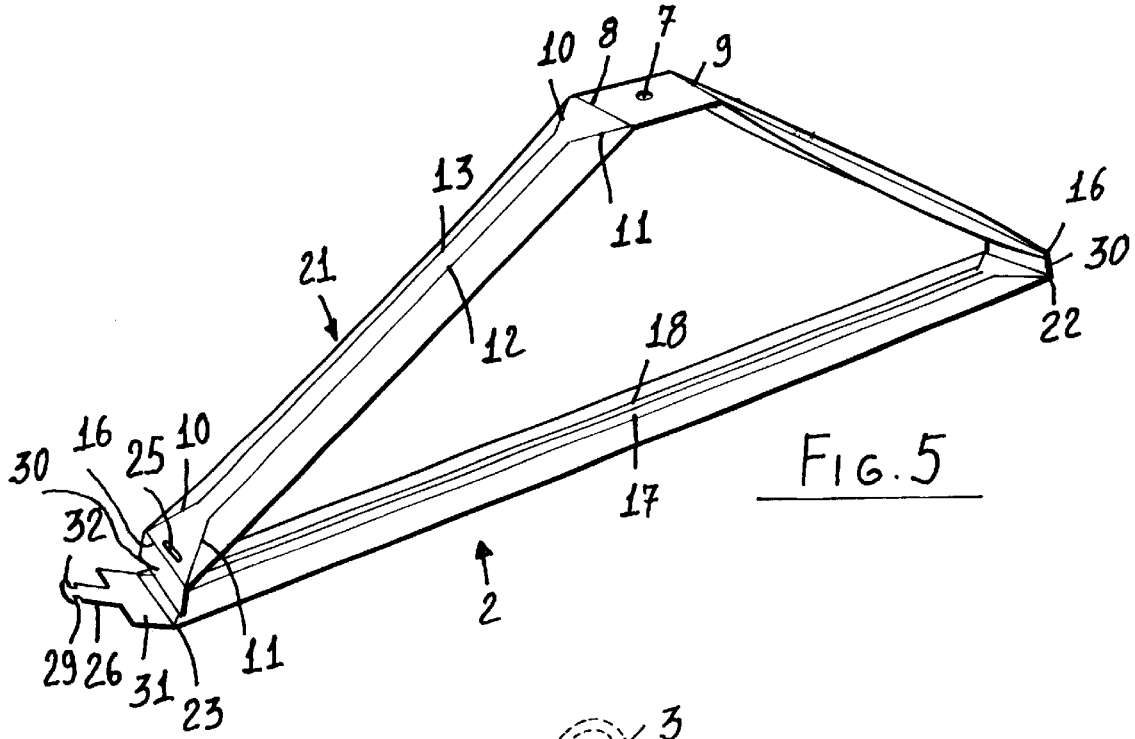
FIG. 5 is a further perspective view of a first modified embodiment of the cloth hanger according to the present invention, which is made by the same making method, but having a triangular cloth hanger construction made from a single element bent on itself; the two opposite ends of said element, used for making a fixing arrangement, are shown separated from one another, in order to clearly illustrate the fixing and closing mechanism providing to use a tongue, formed at one end of the strip body, in a slot formed at an opposite end.
Figure 6:
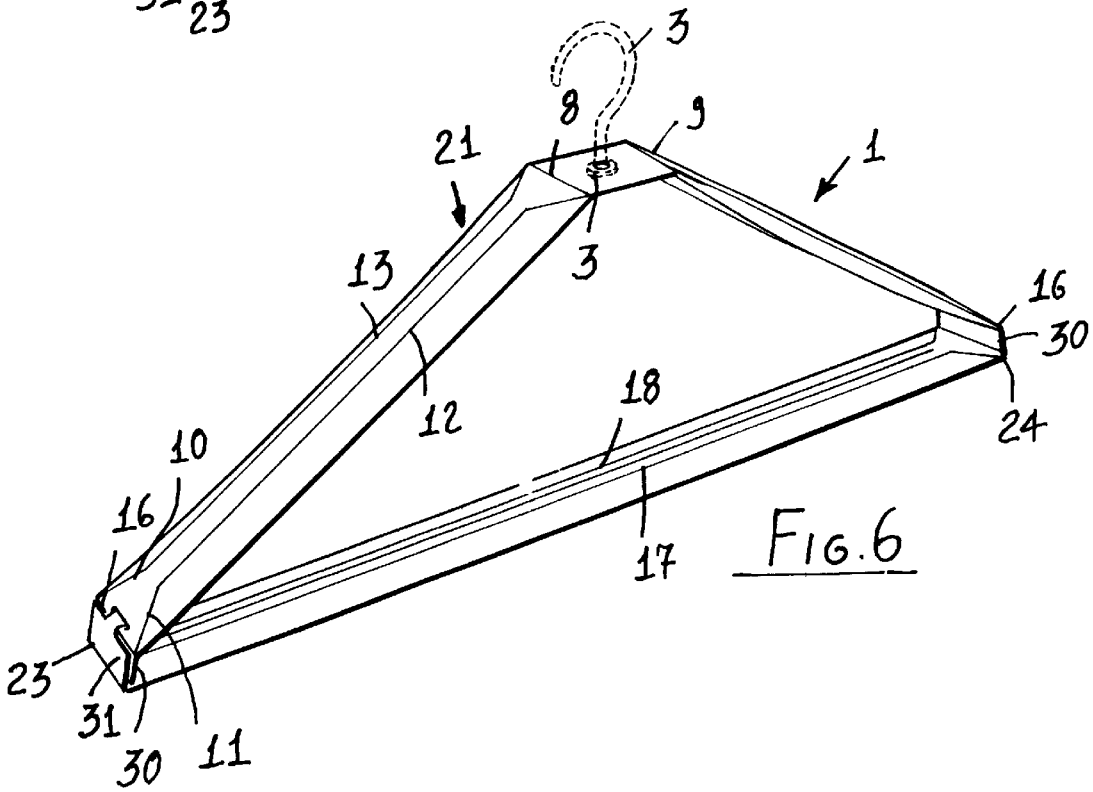
FIG. 6 is a view like FIG. 5, but in which the closing elements are shown in an -already coupled condition.

A first modified embodiment, shown in FIGS. 5 and 6, is substantially differentiated from the first embodiment shown in FIGS. 1, 2, 3 and 4, since it is essentially constituted by a single strip 21 which, after having been processed in a manner analogous to that of the strip 4, is then bent along the bending lines 16, 23 and 24 to form the three sides.

The processing method provides to carry out shearing operations to form the elongated slot 25 and tongue 26 constituting the coupling elements.

The latter, in particular, comprise a side 30 and the elongated slot 29, and the side 31, the tongue 26 ending with two locking symmetrical grooves 29 provided with two projecting wings.

The elongated slot 25 is arranged at a suitable spacing from one end of the profile 21, at the center and with a perpendicular arrangement with respect to the longitudinal axis.

The tongue 26, in particular, is arranged at one end of the strip 21.

Figure 7:
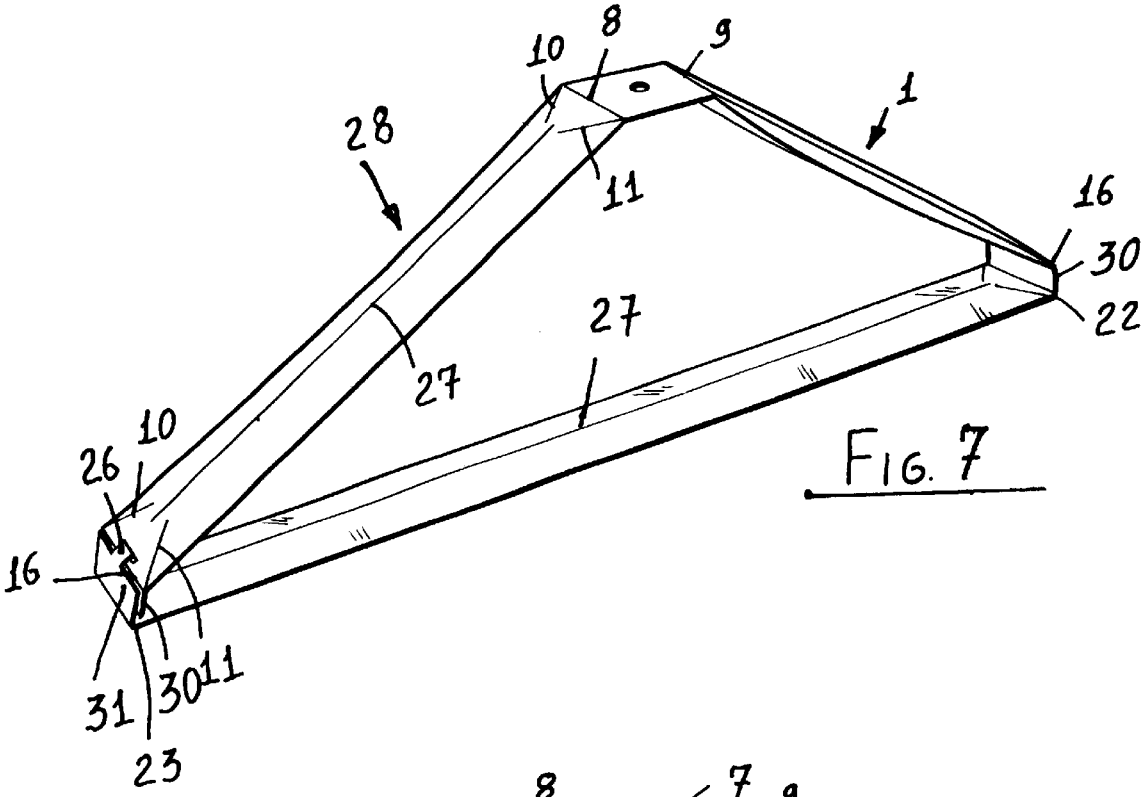
FIG. 7 is a side perspective view of a second modified embodiment of a cloth hanger according to the present invention, made by the making method shown in FIG. 5, and provided with a simplified construction providing to use a single longitudinal central rib on the strip forming the cloth hanger body or section.
Figure 8:
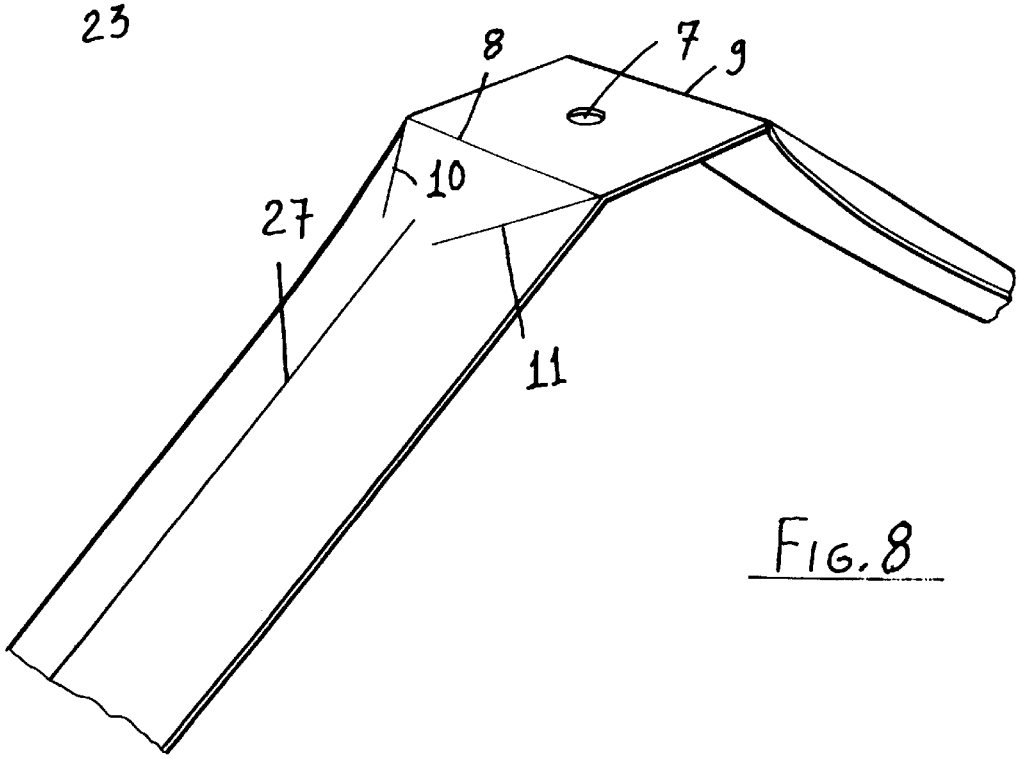
FIG. 8 is a further side perspective view of the top central portion of the cloth hanger shown in FIG. 7.

A further modified embodiment, shown in FIG. 7, is very similar to the first modified embodiment with the exception of the partial ribbed arrangement which is formed longitudinally along a single central line 27 of the strip 28.

All the processing operations of the cardboard material, having a single colour or multiple colours, and a suitable basis weight, can be preceded by a printing of the maker marks or of the supplier marks.

The invention has been thereinabove disclosed by way of a merely illustrative but not limitative example.

In particular, the cloth hanger according to the present invention can also be made of any desired plastic materials, or any other paper based material, laminated to plastic material or other material films.

Moreover, the cloth hanger according to the invention can be variously further modified, without departing from the scope of the invention.

What is claimed is:

1. A cloth hanger, having a triangular construction, said cloth hanger comprising a top strip portion of ribbed paperboard or plastic material, or laminate materials, said top strip portion defining two top strip wings symmetrically slanted that are coupled by an integral middle flat strip portion and a bottom strip portion, wherein said top strip portion and bottom strip portion are an integral strip having a first end and a second end, said first end being formed with an integral tongue for engaging in a slot formed through said second end of said strip.

2. A cloth hanger, according to claim 1, wherein said top strip portion and said bottom strip portion are separated strip portions, said bottom strip portion having groove cut-outs in which are engaged reversed U cuts laterally formed through said two top strip wings of said top strip portion.

3. A cloth hanger, according to claim 2, wherein said bottom strip portion comprises one or more longitudinal ribs providing said bottom strip portion with a tridimensional profile having a V cross section.

4. A cloth hanger, according to claim 1, wherein said middle flat strip portion comprises a hole for engaging therein a hook-shape top lug.

5. A cloth hanger, according to claim 1, wherein said two strip top wings comprise one or more longitudinal ribs and, at each said two strip top wings, a plurality of slanted ribs laterally meeting with further cross ribs.

6. A cloth hanger, according to claim 1, wherein said middle flat strip portion has a surface delimited by two cross ribs formed on said strip.

* * * * *